US009474929B2

(12) United States Patent
Wu

(10) Patent No.: US 9,474,929 B2
(45) Date of Patent: Oct. 25, 2016

(54) METHOD FOR CONTROLLING A BALANCE TRAINING DEVICE BY CHANGING THE POSITION OF A SUPPORTING POINT

(71) Applicant: STRENGTH MASTER FITNESS TECH CO., LTD., Changhua County (TW)

(72) Inventor: Shu-Yao Wu, Taichung (TW)

(73) Assignee: Strength Master Fitness Tech Co., Ltd., Changhua County (TW)

( * ) Notice: Subject to any disclaimer, the term of this patent is extended or adjusted under 35 U.S.C. 154(b) by 0 days.

(21) Appl. No.: 14/600,195

(22) Filed: Jan. 20, 2015

(65) Prior Publication Data

US 2016/0206917 A1 Jul. 21, 2016

(51) Int. Cl.

| | |
|---|---|
| ***A63B 22/18*** | (2006.01) |
| ***A63B 22/16*** | (2006.01) |
| ***A63B 21/00*** | (2006.01) |

(52) U.S. Cl.

CPC ..... *A63B 22/16* (2013.01); *A63B 21/1492* (2013.01); *A63B 21/1496* (2013.01)

(58) Field of Classification Search

CPC .. A63B 22/16; A63B 21/0087; A63B 21/14; A63B 21/16; A63B 21/18; A63B 26/003; A63B 26/00; A63B 22/18; A63B 22/20; A63B 2022/185

See application file for complete search history.

(56) References Cited

U.S. PATENT DOCUMENTS

| | | | | |
|---|---|---|---|---|
| 478,166 | A * | 7/1892 | Madsen | A63B 23/08 482/146 |
| 3,488,049 | A * | 1/1970 | Sasser, Jr. | A63B 22/16 482/146 |
| 4,191,371 | A * | 3/1980 | Armer, Jr. | A63B 21/0004 482/146 |
| 5,813,958 | A | 9/1998 | Tomita | |
| 5,941,807 | A | 8/1999 | Cassidy et al. | |
| 6,176,817 | B1 | 1/2001 | Carey et al. | |
| 6,558,304 | B1 | 5/2003 | Bardon et al. | |
| 7,004,895 | B2 | 2/2006 | Perry et al. | |
| 7,175,577 | B2 | 2/2007 | Greenspan et al. | |
| 7,374,522 | B2 | 5/2008 | Arnold | |
| 7,465,253 | B2 | 12/2008 | Perry et al. | |
| 7,985,169 | B2 | 7/2011 | Tudico | |
| 8,021,288 | B2 * | 9/2011 | Ferrara | A61H 1/003 482/142 |
| 8,360,943 | B2 * | 1/2013 | Smith | A63B 21/0004 482/146 |
| 8,398,531 | B2 | 3/2013 | Tudico | |
| 8,435,164 | B2 * | 5/2013 | VanBuren | A63B 26/003 482/145 |
| 8,529,418 | B2 | 9/2013 | Stewart et al. | |
| 8,540,519 | B1 * | 9/2013 | Lauter | A63B 26/003 434/247 |
| 2008/0207410 | A1 * | 8/2008 | Tacconi | A63B 22/18 482/123 |

* cited by examiner

*Primary Examiner* — Oren Ginsberg
*Assistant Examiner* — Megan Anderson
(74) *Attorney, Agent, or Firm* — Rosenberg, Klein & Lee

(57) ABSTRACT

A method for controlling a balance training device by changing the position of a supporting point. The balance training device includes a base and a platform. A supporting member is adapted between the base and the platform to abut against the platform. The point of the platform where the supporting member is abutted against is the supporting point. The platform or the supporting member is movable, the method includes actuating the platform or the supporting member to move, so that the platform is moved relative to the supporting member; changing the position of the supporting point; and allowing the platform to be in a tilted state based on the change of the position of the supporting point. Therefore, a user can use the method for balance training.

9 Claims, 7 Drawing Sheets

METHOD FOR CONTROLLING A BALANCE TRAINING DEVICE BY CHANGING THE POSITION OF A SUPPORTING POINT

BACKGROUND OF THE INVENTION

1. Field of the Invention

The present invention relates to a controlling method for balance training device, and more particularly to a controlling method by changing the position of the supporting point defined in a balance training device.

2. Description of the Prior Art

As shown in FIG. 7, a conventional balance training device includes a base 41, a supporting member 42 and a platform 43. Wherein the supporting member 42 is standing on the base 41, and one end of the supporting member 42 is pivoted with the platform 43 and abutted against the platform 43. In detail, the supporting member 42 has a ball-shaped pivoting portion 44 adapted to one end thereof, and the platform 43 defines a pivoting cavity 45. Thus, the pivoting portion 44 of the supporting member 42 is received in the pivoting cavity 45, enabling the platform 43 to freely pivot universally relative to the supporting member 42 and allowing the platform 43 to be in a tilted state. Accordingly, a user can stand on the platform 43 and try to make the platform 43 be horizontal, so that the muscle of the user can be trained.

However, the position of the pivoting cavity 45 is fixed; that is, the relative position between the supporting member 42 and the platform 43 is unchanged. Therefore, the user can make the platform 43 be horizontal easily when standing on and the conventional balance training device can hardly provide an effect for training the muscle of the user, due to the platform 43 is tilted within a simple rule.

The present invention is, therefore, arisen to obviate or at least mitigate the above mentioned disadvantages.

SUMMARY OF THE INVENTION

An object of the present invention is to provide a method for controlling a balance training device by changing the position of a supporting point of the balance training device. Accordingly, the platform of the balance training device would be tilted by changing the position of the supporting point, and the user on the platform can adjust his/her postures for balance training.

To achieve the above and other objects, a method for controlling a balance training device by changing the position of a supporting point of the balance training device is provided. The balance training device comprises a base and a platform. A supporting member is adapted between the base and the platform to abut against the platform, and a reference point is defined at the platform. The point of the platform where the supporting member is abutted against is the supporting point. The platform or the supporting member is movable. The method comprises actuating the platform or the supporting member to move, so that the platform is moved relative to the supporting member; changing the position of the supporting point relative to the reference point by the movement of the platform or the movement of the supporting member; and allowing the platform to be in a tilted state based on the change of the position of the supporting point.

In another implementation, a method for controlling a balance training device by changing the position of a supporting point of the balance training device is provided. The balance training device comprises a base and a platform. A supporting member is adapted between the base and the platform to abut against the platform. An edge is defined around the periphery of the platform. The point of the platform where the supporting member is abutted against is the supporting point. The distance between the supporting point and the edge is defined as a lever arm. The platform or the supporting member is movable. The method comprises actuating the platform or the supporting member to move, so that the platform is moved relative to the supporting member; changing the length of the lever arm; and allowing the platform to be in a tilted state based on the change of the length of the lever arm.

In one implementation aspect, the platform or the supporting member is actuatable to perform a one dimensional displacement or a two dimensional displacement planarly. The platform and the supporting member may have three actuating modes. The first mode is only actuating the platform to move, wherein the position of the supporting member relative to the base is unchanged. The second mode is only actuating the supporting member to move, wherein the position of the platform relative to the base is unchanged. The third mode is simultaneously actuating the supporting member and the platform, wherein the moving direction of the platform is the same as or different from the moving direction of the supporting member.

In one variation, the supporting member is slidably connected to the platform. Furthermore, the connection between the supporting member and the platform can be carried out by two modes. In a first mode, the platform is tilted relative to the supporting member using the supporting point as a pivoting center. In a second mode, the supporting member comprises an upper segment and a lower segment. The upper segment is abutted against the platform. The upper segment and the lower segment are pivoted to each other by a pivoting portion, so that the platform is tilted using the pivoting portion as a pivoting center.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
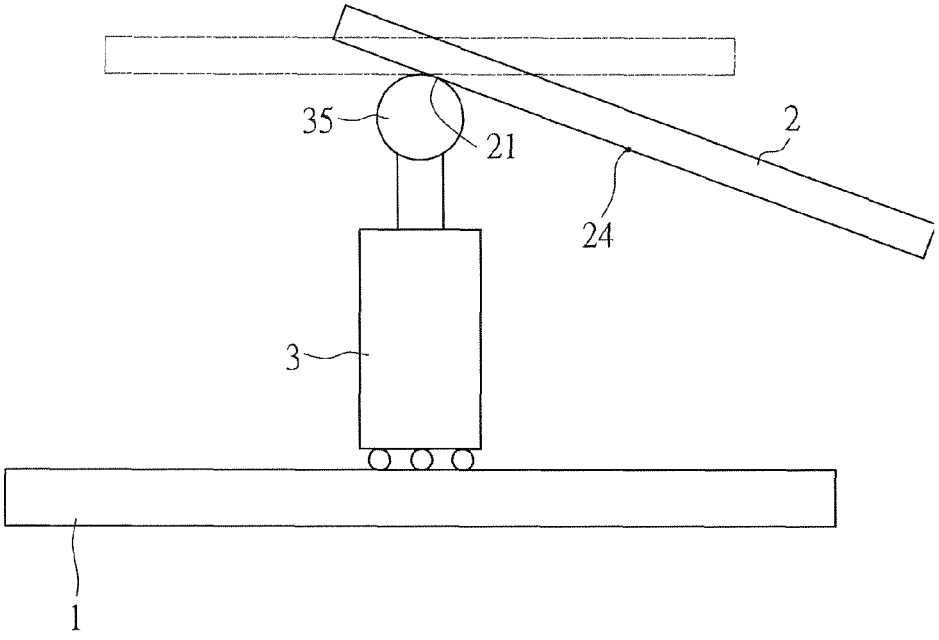
FIG. 1 is a schematic view showing a first implementation aspect of a first embodiment of a balance training device applicable to the present invention.
Figure 2:
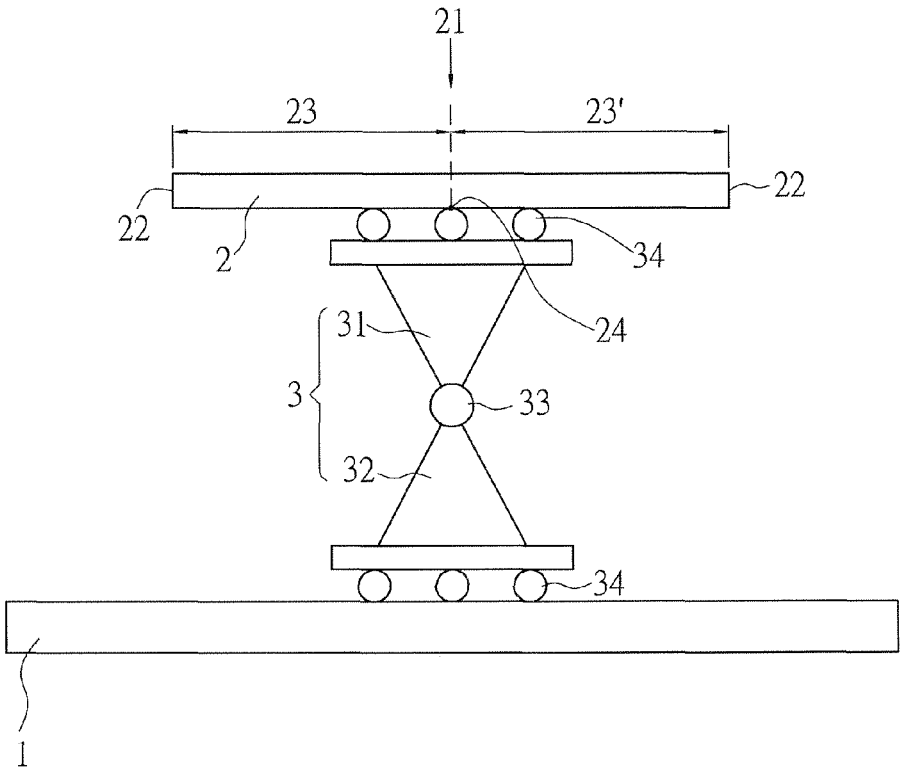
FIG. 2 is a schematic view showing a second implementation aspect of the first embodiment of the balance training device applicable to the present invention.

The present invention provides a method for controlling a balance training device by changing the position of a supporting point 21. As shown in FIG. 1 and FIG. 2, the balance training device comprises a base 1 and a platform 2. The base 1 is disposed on the ground, and the platform 2 is above the base 1. A supporting member 3 is adapted between the base 1 and the platform 2 to abut against the platform 2. The supporting member 3 is abutted against a bottom plane of the platform 2. A reference point 24 is defined at the platform 2, and the point of the platform 2 where the supporting member 3 is abutted against is the supporting point 21. Here, the position of the reference point 24 is not limited by the present invention. The reference point 24 is fixed and provided as a reference for the supporting point 21.

As respectively shown in FIG. 1 and FIG. 2, two implementation aspects of the connection between the supporting member 3 and the platform 2 are described as follows. Please refer to FIG. 1, in which a first implementation aspect of the balance training device is provided, wherein the supporting member 3 comprises a pivoting portion 35 adapted to a top thereof, and the pivoting portion 35 is pivoted to the bottom plane of the platform 2. Furthermore, the pivoting portion 35 is connected to the platform 2 and slidably movable relative to the platform 2. Please refer to FIG. 2, in which a second implementation aspect of the balance training device is provided, wherein the supporting member 3 comprises an upper segment 31 and a lower segment 32. The upper segment 31 and the lower segment 32 are pivoted to each other by a pivoting portion 33, so that the upper segment 31 is pivotally rotatable relative to the lower segment 32. A proper friction may be provided between the pivoting portion 33 and the upper segment 31. A top of the upper segment 31 is abutted against the bottom plane of the platform 2, and a bottom of the lower segment 32 is adapted on the base 1, The upper segment 31 is not fixedly connected with the platform 2, and the lower segment 32 is not fixedly connected with the base 1; instead, the upper segment 31 is movable relative to the platform 2, and the lower segment 32 is movable relative to the base 1. Here, the connection between the upper segment 31 and the platform 2 and the connection between the lower segment 32 and the base 1 are not limited. FIG. 2 illustrates an example about the connection between the upper segment 31 and the platform 2 and the connection between the lower segment 32 and the base 1. As shown in FIG. 2, sliding members 34 are provided between the upper segment 31 and the platform 2 and between the lower segment 32 and the base 1, so that the upper segment 31 is movable relative to the platform 2 and the lower segment 32 is movable relative to the base 1.

The balance training device can be actuated by different kinds of actuating devices or actuating methods, so that the platform 2 is moved relative to the supporting member 3. In this embodiment, the platform 2, the supporting member 3 or both the platform 2 and the supporting member 3 can be actuated so that the platform 2 or the supporting member 3 performs a one dimensional displacement.

Accordingly, the method according to the present invention comprises: actuating the platform 2 or the supporting member 3 to move, so that the platform 2 is moved relative to the supporting member 3; changing the position of the supporting point 21 relative to the reference point 24 by the movement of the platform 2 or the movement of the supporting member 3; and allowing the platform 2 to be in a tilted state based on the change of the position of the supporting point 21.

In detail, due to the platform 2 is movable relative to the supporting member 3, the position of the supporting member 3 relative to the platform 2 can be changed by simply actuating the platform 2, the supporting member 3 or both the platform 2 and the supporting member 3 to move. Three actuating modes are described below. The first mode is only actuating the platform 2 to move, wherein the position of the supporting member 3 relative to the base 1 is unchanged. The second mode is only actuating the supporting member 3 to move, wherein the position of the platform 2 relative to the base 1 is unchanged. The third mode is simultaneously actuating the supporting member 3 and the platform 2, wherein the moving direction of the platform 2 is the same as or different from the moving direction of the supporting member 3. That is, based on the aforementioned three actuating modes, the position of the supporting point 21 of the platform 2 where the supporting member 3 is abutted against can be changed relative to the reference point 24 so as to allow the platform 2 in corresponding tilted states.

Figure 3:
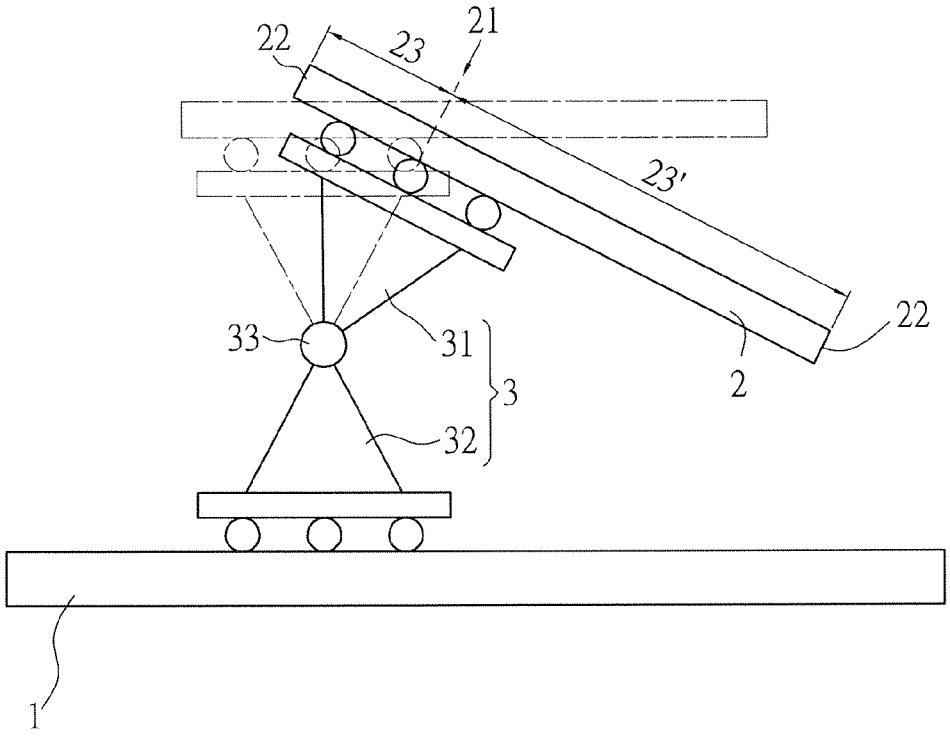
FIG. 3 is a schematic operational view of the balance training device shown in FIG. 2.

Accordingly, as shown in FIG. 2, an edge 22 is defined around the periphery of the platform 2, and the distance between the supporting point 21 and the edge 22 is defined as a lever arm 23, 23'. As shown in FIG. 3, when the supporting member 3 is moved relative to the platform 2, the position of the supporting point 21 is changed, and the lengths of the lever arms 23, 23' defined between two opposites points at the edge 22 and the supporting point 21 are changed, such that a first length of the lever arm 23 defined between a first point at the edge 22 and the supporting point 21 is not equal to a second length of the lever arm 23' defined between a second point at the edge 22 and the supporting point 21. Thus, the platform 2 is in a tilted state based on the lever principle. In one implementation aspect shown in FIG. 1, the platform 2 is tilted using the supporting point 21 as a pivoting center. In another implementation aspect shown in FIG. 3, the platform 2 is tilted by the pivot between the upper segment 31 and the lower segment 32 of the supporting member 3, so that the user on the platform 2 can change his/her posture to make the platform 2 be horizontal, enabling the user to have balance training.

According to the present invention, the position of the supporting point 21 of the platform 2 where the supporting member 3 is abutted against is changed so as to allow the platform 2 in a tilted state. Therefore, different tilt modes are provided for the user, and the user can perform postures exactly for keeping balance on the platform 2 and have efficient balance training.

Figure 4:
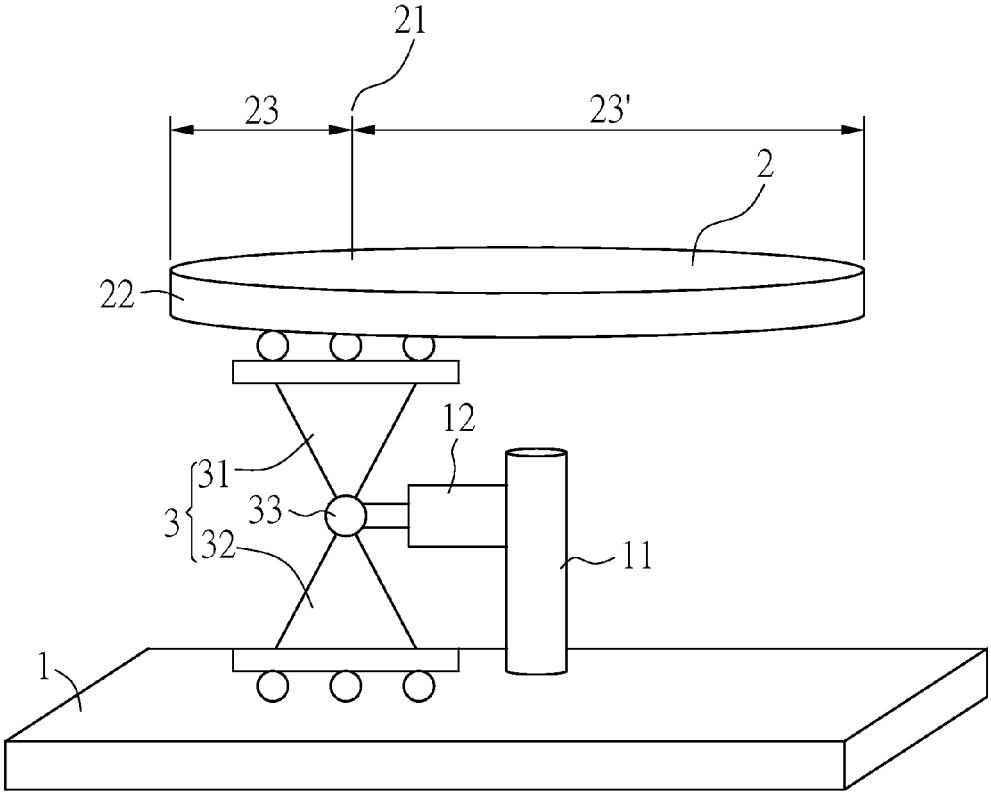
FIG. 4 is a schematic view showing a second embodiment of a balance training device applicable to the present invention.
Figure 5:
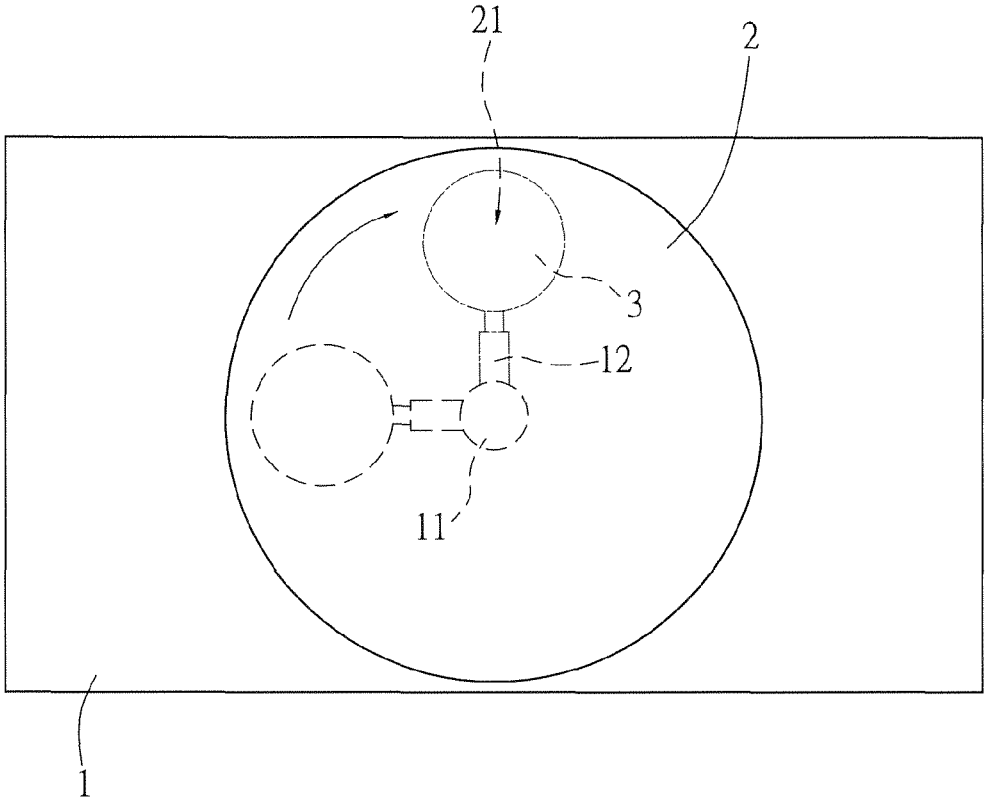
FIG. 5 is a schematic operational view (1) of the balance training device shown in FIG. 4.
Figure 6:
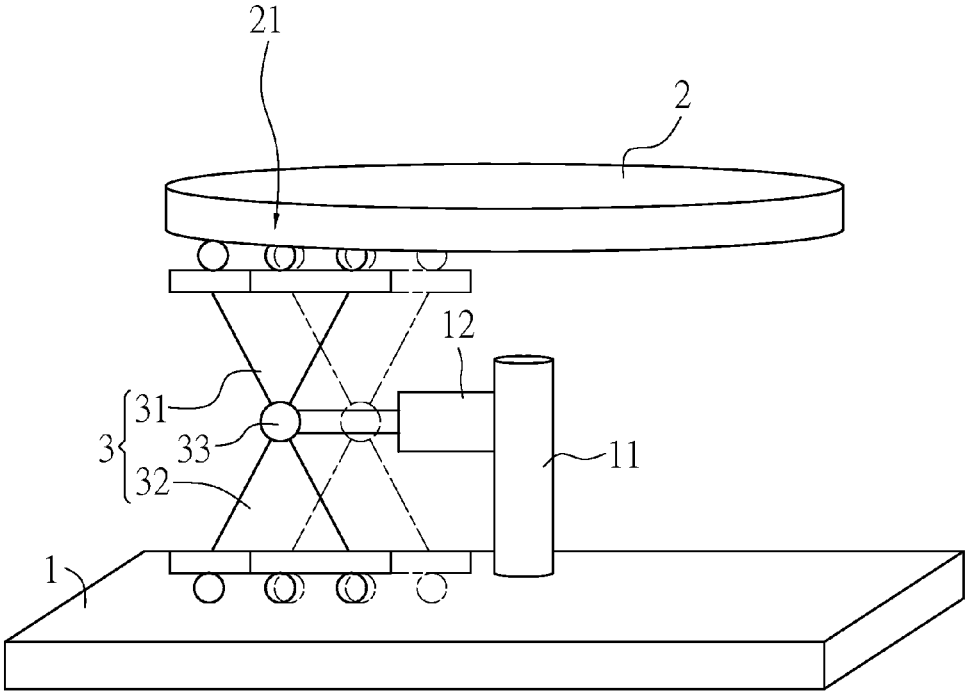
FIG. 6 is a schematic operational view (2) of the balance training device shown in FIG. 4.
Figure 7:
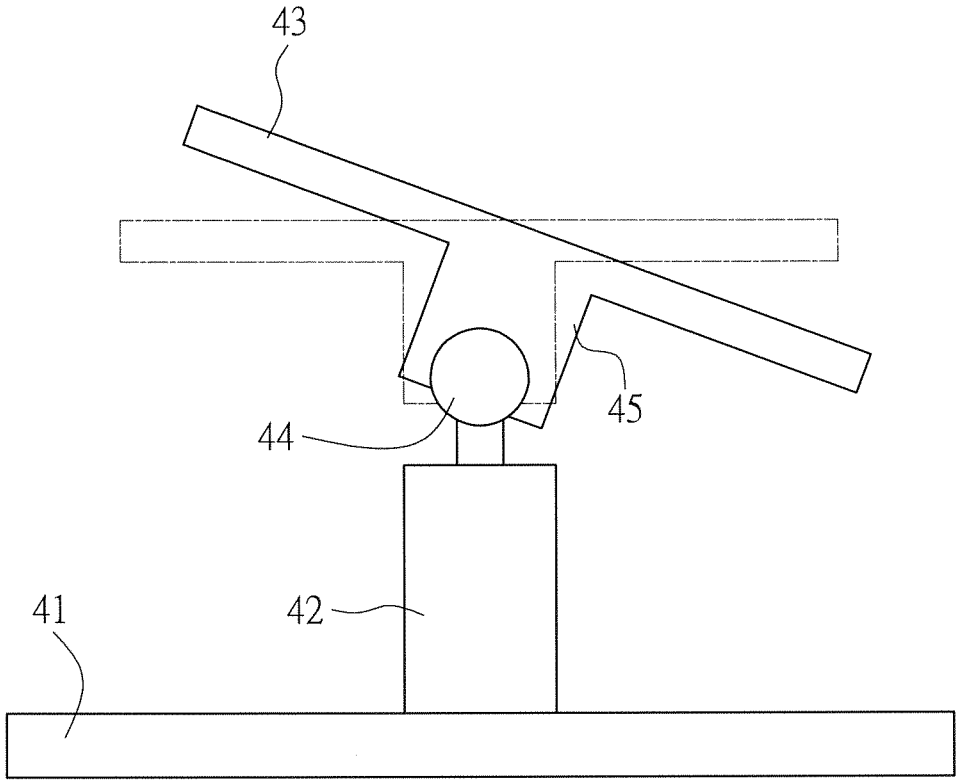
FIG. 7 PRIOR ART
FIG. 7 is a schematic operational view of a conventional balance training device.

FIG. 4 is a schematic view showing a second embodiment of a balance training device applicable to the present invention. The balance training device is designed based on the aforementioned first embodiment. In the second embodiment, a rotating shaft 11 is pivoted to the base 1, and a retractable device 12 is extending from the rotating shaft 11. The length of the retractable device 12 can be changed by extending or retracting the retractable device 12. The retractable device 12 is connected to the supporting member 3. The rotating shaft 11 can be actuated to rotate by different kinds of actuating devices or actuating methods, so that the rotation of the rotating shaft 11 drives the supporting member 3 to rotate around the rotating shaft 11, as shown in FIG. 5. Furthermore, due to the change of the length of the retractable device 12, the distance between the supporting member 3 and the rotating shaft 11 can be changed, as shown in FIG. 6. Based on this, a two dimensional displacement of the supporting member 3 relative to the platform 2 can be performed, and the position of the supporting point 21 of the platform 2 where the supporting member 3 is abutted against can be changed. Accordingly, the platform 2 is in a tilted state based on the lever principle and provided for balance training.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A method for controlling a balance training device by changing the position of a supporting point, wherein the balance training device comprises a base and a platform, the base is disposed on a ground, a supporting member is adapted between the base and the platform to abut against the platform, an edge is defined around the periphery of the platform, and a point of the platform where the supporting member abuts against is defined as a supporting point, a distance between the supporting point and the edge is defined as a lever arm, wherein the platform or the supporting member is movable, the method comprising:

actuating the platform or the supporting member to move, so that the platform or the supporting member is moved relative to each other;

changing the length of the lever arm; and allowing the platform to be in a tilted state based on the change of the length of the lever arm;

wherein the platform is tilted using the supporting point as a pivoting center.

2. The method for controlling a balance training device by changing the position of a supporting point according to claim 1, wherein the platform or the supporting member is actuatable to perform a one dimensional displacement or a two dimensional displacement planarly.

3. The method for controlling a balance training device by changing the position of a supporting point according to claim 1, wherein the supporting member is slidably connected to the platform.

4. The method for controlling a balance training device by changing the position of a supporting point according to claim 1, further comprising:

simultaneously actuating the platform and the supporting member to move, wherein the moving direction of the platform is the same as or different from the moving direction of the supporting member.

5. A The method for controlling a balance training device by changing the position of a supporting point, wherein the balance training device comprises a base and a platform, the base is disposed on a ground, a supporting member is adapted between the base and the platform to abut against the platform, an edge is defined around the periphery of the platform, and a point of the platform where the supporting member abuts against is defined as a supporting point, a distance between the supporting point and the edge is defined as a lever arm, wherein the platform or the supporting member is movable, the method comprising:

actuating the platform or the supporting member to move, so that the platform or the supporting member is moved relative to each other;

changing the length of the lever arm; and allowing the platform to be in a tilted state based on the change of the length of the lever arm;

wherein the supporting member has an upper segment and a lower segment, the upper segment is abutted against the platform, wherein the upper segment and the lower segment are pivoted to each other by a pivoting portion, so that the platform is tilted using the pivoting portion as a pivoting center.

6. The method for controlling a balance training device by changing the position of a supporting point according to claim 5, further comprising:

simultaneously actuating the platform and the supporting member to move, wherein the moving direction of the platform is the same as or different from the moving direction of the supporting member.

7. The method for controlling a balance training device by changing the position of a supporting point according to claim 5, wherein the supporting member is slidably connected to the platform.

8. The method for controlling a balance training device by changing the position of a supporting point according to claim 5, wherein the platform or the supporting member is actuatable to perform a one dimensional displacement or a two dimensional displacement planarly.

9. A method for controlling a balance training device by changing the position of a supporting point, wherein the balance training device comprises a base and a platform, the base is disposed on a ground, a supporting member is adapted between the base and the platform to abut against the platform, an edge is defined around the periphery of the platform, and a point of the platform where the supporting member abuts against is defined as a supporting point, a distance between the supporting point and the edge is defined as a lever arm, wherein the platform or the supporting member is movable, the method comprising:

actuating the platform or the supporting member to move, so that the platform or the supporting member is moved relative to each other;

changing the length of the lever arm;

allowing the platform to be in a tilted state based on the change of the length of the lever arm; and, only actuating one of the platform or supporting member to move, wherein the position of the supporting member relative to the base is unchanged when the platform is actuated to move, and the position of the platform relative to the base is unchanged when the supporting member is actuated to move.

* * * * *